US006173700B1

(12) United States Patent
Yamashita et al.

(10) Patent No.: US 6,173,700 B1
(45) Date of Patent: Jan. 16, 2001

(54) CONTROLLER FOR CYLINDER INJECTION TYPE INJECTORS

(75) Inventors: Manabu Yamashita; Tetsushi Watanabe, both of Tokyo (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/420,030

(22) Filed: Oct. 18, 1999

(30) Foreign Application Priority Data

May 13, 1999 (JP) ..... 11-132897

(51) Int. Cl.[7] ..... F02M 51/00
(52) U.S. Cl. ..... 123/490
(58) Field of Search ..... 123/490; 361/154

(56) References Cited

U.S. PATENT DOCUMENTS 5,251,091 * 10/1993 Ito et al. ..... 123/490
5,531,198 * 7/1996 Matsuura ..... 123/490
5,884,896 * 3/1999 Kono et al. ..... 123/490
5,947,090 * 9/1999 Maeda ..... 123/490
6,044,823 * 4/2000 Watanabe ..... 123/490
6,102,008 * 8/2000 Maeda et al. ..... 123/490

FOREIGN PATENT DOCUMENTS 11-50891 2/1999 (JP) .

* cited by examiner

*Primary Examiner*—John Kwon
(74) *Attorney, Agent, or Firm*—Sughrue, Mion, Zinn, Macpeak & Seas, PLLC

(57) ABSTRACT

A controller for cylinder injection type injectors is constructed so that current detection element for detecting currents flowing through injector coils are inserted between a connection point of first switching element and the nodes of reverse current blocking diodes and current commutation diodes, respectively, and over-current detection element do not include circuits for temporarily interrupting over-current detection operations based on output signals of over-excitation signal generation element. That is, the current detection element are arranged at paths not admitting the flow of over-excitation currents, so that power dissipations at the current detection element can be reduced. Further, the circuits for temporarily interrupting the operations of the over-current detection element while over-excitation currents are being supplied are dispensed with. As a result of these arrangements, the present invention can provide a small-sized, lightweight and inexpensive controller capable of detecting over-currents in a wide range.

3 Claims, 4 Drawing Sheets

CONTROLLER FOR CYLINDER INJECTION TYPE INJECTORS

BACKGROUND OF THE INVENTION

Field of the Invention

The present invention relates to a controller for cylinder injection type injectors in fuel injection systems for cylinder injection type gasoline engines, or fuel injection systems for diesel engines. More particularly, the present invention relates to a controller for cylinder injection type injectors capable of reducing heat, and reducing the scale of circuits, the size of the controller and hence the production cost of the controller by improving a method of detecting currents flowing through injector coils constituting the injectors.

FIG. 4 is a diagram showing the construction of an exemplary conventional controller for cylinder injection type injectors disclosed in Japanese Patent Application No. Hei 10-165132.

In FIG. 4, various types of sensors 1 for detecting the operating states of an internal combustion engine are provided. Information about the operating states to be detected by these sensors includes, e.g., the throttle opening, intake air amount, engine r.p.m. and engine coolant water.

Control parameter calculation means 2 is constructed of a microcomputer for calculating control parameters, such as fuel injection amount and fuel injection period for supplying a fuel to each cylinder of the internal combustion engine, based on the detection results obtained by the sensors 1 for detecting the operating states of the internal combustion engine. The means 2 outputs, to a controller 4 for cylinder injection type injectors, control signals Cl to Cn for driving the cylinder injection type injectors, respectively, in correspondent with the cylinders of the internal combustion engine. A battery 3 serving as the power source for a vehicle supplies a battery voltage VB.

High voltage generation means 5 for generating high voltage based on the voltage value VB of the battery 3 is provided within the controller 4 for the cylinder injection type injectors. The means 5 generates a high voltage VH by boosting the voltage value VB supplied by the battery 3.

Injector coils 6-1 to 6-n correspond to drive circuits 7-1 to 7-n, respectively. The injector coils 6-1 to 6-n constitute first to nth cylinder injection type injectors. The injectors, respectively arranged for the cylinders of the internal combustion engine, directly inject the fuel into the corresponding cylinders. The drive circuits 7-1 to 7-n supply currents J1 to Jn to the injector coils 6-1 to 6-n as fuel injection signals.

The injector coil drive circuits 7-1 to 7-n arranged so as to correspond to the injector coils 6-1 to 6-n supply the currents J1 to Jn, which are the fuel injection signals, to the injector coils 6-1 to 6-n, respectively, based on the control signals C1 to Cn outputted from the control parameter calculation means 2.

Over-excitation signal generation means 8-1 to 8-n synchronize with the ON timings of the control signals C1 to Cn outputted from the control parameter calculation means 2, and define predetermined time intervals during which over-excitation currents necessary for initially opening the valves of the nozzles of the cylinder injection type injectors rapidly are supplied to the injector coils 6-1 to 6-n from the high voltage generation means 5 through first switching means 9-1 to 9-n, respectively. The means 8-1 to 8-n output the defined time intervals as over-excitation signals E1 to En.

The first switching means 9-1 to 9-n remain turned on while the over-excitation signals E1 to En outputted from the overexcitation signal generation means 8-1 to 8-n are held at the ON state, and hence the means 9-1 to 9-n allow the over-excitation currents to be supplied to the injector coils 6-1 to 6-n from the high voltage generation means 5.

Chopping type holding current generation means 10-1 to 10-n supply, to the injector coils 6-1 to 6-n, holding currents necessary for the injectors to hold the valves of their nozzles open operation while the control signals C1 to Cn outputted from the control parameter calculation means 2 are held at the ON state (after the over-excitation time has elapsed). That is, the chopping type holding current generation means 10-1 to 10-n compare voltage values VS1 to VSn, which are the detection results obtained by current detection means 13-1 to 13-n, with holding current reference voltage values set by themselves, and intermittently supply the battery voltage VB to the injector coils 6-1 to 6-n by controlling the ON/OFF switching operations of second switching means 11-1 to 11-n so that the holding currents are always constant.

The second switching means 11-1 to 11-n start and stop the supply of the voltage value VB from the battery 3 in accordance with the outputs of the chopping type holding current generation means 10-1 to 10-n.

Third switching means 12-1 to 12-n incorporate high-speed current breaking function for rapidly turning off the current when breaking the currents flowing through the injector coils 6-1 to 6-n. The means 12-1 to 12-n are normally turned on, and get turned off upon removal of the control signals C1 to Cn. The means 12-1 to 12-n also have the function of rapidly breaking the currents generated by induced counter-electromotive forces generated at the injector coils 6-1 to 6-n.

The current detection means 13-1 to 13-n detect the currents flowing through the injector coils 6-1 to 6-n. Each current detection means includes, e.g., a current-to-voltage conversion shunt resistor and a differential amplifier connected across both ends of the shunt resistor. The means 13-1 to 13-n are interposed between the third switching means 12-1 to 12-n and the ground, and detect all the currents (over-excitation currents and holding currents) flowing through the injector coils 6-1 to 6-n. Their detection results, which are the voltage values VS1 to VSn, are inputted to the chopping type holding current generation means 10-1 to 10-n and over-current detection means 14-1 to 14-n.

The over-current detection means 14-1 to 14-n detect excessively large currents flowing through the injector coils 6-1 to 6-n based on the voltage values VS1 to VSn corresponding to the currents detected by the current detection means 13-1 to 13-n, i.e., the means 14-1 to 14-n detect the fact that the values VS1 to VSn have grown larger than the reference values within the normal control range. The means 14-1 to 14-n then output voltage values F1 to Fn.

When the over-current detection means 14-1 to 14-n detect the excessively large currents flowing through the injector coils 6-1 to 6-n, failure determination holding means 15-1 to 15-n determine that the injectors for the cylinders have failed, and change the third switching means 12-1 to 12-n from the ON state to the OFF state, thereby rapidly breaking the currents flowing through the injector coils 6-1 to 6-n, and at the same time, output signals H1 to Hn for controlling the third switching means 12-1 to 12-n in order to continuously hold the third switching means 12-1 to 12-n at the OFF states during the operation period.

Diodes D1 to Dn are inserted between the second switching means 11-1 to 11-n and the injector coils 6-1 to 6-n, and are reverse current blocking diodes for blocking the flow of the over-excitation currents supplied from the high voltage generation means 5 via the first switching means 9-1 to 9-n into the second switching means 11-1 to 11-n.

Current commutation diodes D11 to Dnn constitute commutating current paths for allowing currents flowing through the injector coils 6-1 to 6-n to continuously flow while the second switching means 11-1 to 11-n are turned off. The currents commutate through the following paths: from the injector coils 6-1 to 6n, to the third switching means 12-1 to 12-n, then to the current detection means 13-1 to 13-n, then to the current commutation diodes D11 to Dnn, and back to the injector coils 6-1 to 6-n.

By the way, the conventional controller for the cylinder injection type injectors supplies the over-excitation currents necessary for initially opening the valves of the injector nozzles from the high voltage generation means via the paths constituted by the first switching means, the injector coils, the third switching means, the current detection means and the circuit ground in the stated order. After the valves of the injector nozzles have been opened, the holding currents necessary for holding the valves open operation are supplied by causing the chopping type holding current generation means to turn the second switching means on and off, based on the detection results obtained by the current detection means, from the battery via the paths constituted by the second switching means, the reverse current blocking diodes, the injector coils, the third switching means, the current detection means and the circuit ground in the stated order, as well as via the paths constituted by the injector coils, the third switching means, the current detection means and the current commutation diodes in the stated order. However, since the current detection means admit the flow of all the currents supplied to the injector coils (the over-excitation currents and the holding currents) as described above, the current detection means need to have a large allowable power dissipation in order to allow heat derived from these currents.

Further, the detection results obtained by the current detection means are also inputted to the over-current detection means, and hence the current detection means also have the function of disenergizing the third switching means corresponding to the injector coils for the cylinders suffering from over-currents by detecting the over-currents flowing through the injector coils. Therefore, to operate the thus constructed conventional controller properly, the over-excitation currents necessary for initially opening the valves of the injector nozzles should not be detected for abnormal over-currents, and hence the function of the over-current detection means in the conventional controller needs to be temporarily interrupted based on the signals of the over-excitation signal generation means.

Therefore, the conventional controller for cylinder injection type injectors uses large parts for constructing the current detection means with a large allowable power dissipation, and also needs the circuits for temporarily interrupting the function of the over-current detection means, and hence the circuit scale of the controller as a whole is increased. As a result, there arise problems in that the controller itself becomes large in structure in order to provide a capacity large enough to accommodate large circuits therein and a surface area large enough to suppress heat, and hence the production cost of the controller is elevated.

SUMMARY OF THE INVENTION

The present invention has been made to overcome the aforementioned problems. An object of the present invention is therefore to provide a controller for cylinder injection type injectors capable of reducing heat, and reducing the circuit scale, the size of the controller and the production cost of the controller by using small-power-dissipation parts while changing the location of the current detection means and by dispensing with the circuits for temporarily interrupting the function of the over-current detection means.

According to a first aspect of the present invention, there is provided a controller for cylinder injection type injectors comprising: various types of sensors for detecting operating states of an internal combustion engine; control parameter calculation means for calculating control parameters, which are a fuel injection amount and a fuel injection period for supplying a fuel to ech cylinder of the internal combustion engine, based on the detection results obtained by the various types of sensors; high voltage generation means for generating a high voltage power supply for supplying over-excitation currents necessary for initially opening valves of injector nozzles to injector coils based on the result of a calculation made by the control parameter calculation means; over-excitation signal generation means for defining predetermined time intervals for supplying the over-excitation currents to the injector coils; first switching means for supplying the over-excitation currents to the injector coils from the high voltage generation means based on the outputs of the over-excitation signal generation means; holding current generation means for generating holding currents which are necessary to hold the valves of the injector nozzles open and which are supplied to the injector coils after the over-excitation currents have been supplied; second switching means for supplying the holding currents to the injector coils from a battery based on the outputs of the holding current generation means; and third switching means for breaking currents flowing through the injector coils in order to close the valves of the injector nozzles; current detection means, arranged at paths not admitting the flow of the over-excitation currents supplied from the high voltage generation means through the first switching means, for detecting currents flowing through the injector coils; over-current detection means for detecting excessively large currents flowing through the injector coils based on the detection results obtained by the current detection means; and failure determination holding means for holding the third switching means at the disenergized states based on the detection results obtained by the over-current detection means.

According to this arrangement, the power dissipation of the whole current detection means is reduced, and hence the circuits can be constructed by parts exhibiting low power dissipation. As a result, the circuit scale can be reduced, and this in turn allows the surface area of the controller necessary for radiating heat to be reduced. Consequently, such effects may be obtained that the controller for cylinder injection type injectors can be made small-sized, lightweight and inexpensive.

According to a second aspect of the present invention, in a controller for cylinder injection type injectors of the first aspect of the present invention, the over-current detection means can detect all over-currents derived from failures during an energized period based on the detection results obtained by the current detection means.

According to this arrangement, the circuits for temporarily interrupting the operation of the over-current detection means while the over-excitation currents are flowing can be dispensed with. As a result, such effects may be obtained that the controller for cylinder injection type injectors of the present invention can detect over-currents in a wider range than the conventional controller for cylinder injection type injectors, and at the same time, the controller of the present invention can be made small-size, lightweight and inexpensive as a result of the circuit scale being reduced.

According to a third aspect of the present invention, in a controller for cylinder injection type injectors of the first aspect of the present invention, the current detection means are arranged at paths admitting all of holding currents supplied to the injector coils through the second switching means, commutating currents flowing while the second switching means are turned off, and high-speed commutating currents flowing while the third switching means are turned off, and can detect all currents other than the over-excitation currents.

According to this arrangement, the controller can be made small-sized, lightweight and inexpensive.

DETAILED DESCRIPTION OF THE PREFERRED EMBODIMENT

Figure 1:
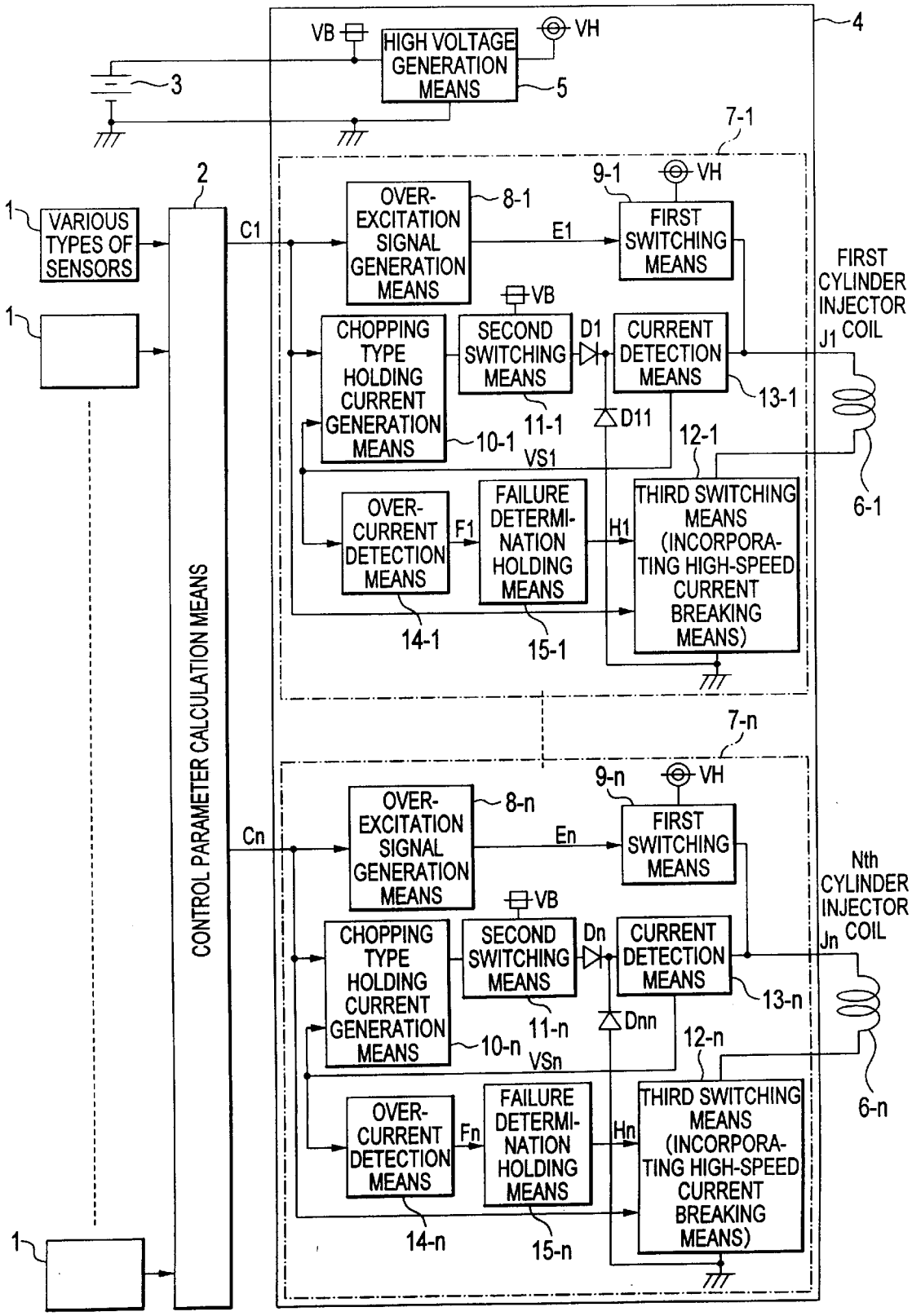
FIG. 1 is a diagram showing the construction of a controller for cylinder injection type injectors according to an embodiment 1 of the present invention.

FIG. 1 is a diagram showing the construction of an embodiment 1 of the present invention, which is, e.g., a fuel controlling system for cylinder injection type gasoline engines or a controller for cylinder injection type injectors in fuel injection systems for diesel engines.

In FIG. 1, various types of sensors 1 for detecting the operating states of an internal combustion engine are provided. Information about the operating states to be detected by these sensors includes, e.g., the throttle opening, intake air amount, engine r.p.m. and engine coolant water.

Control parameter calculation means 2 is constructed of a microcomputer for calculating control parameters such as fuel injection amount and fuel injection period for supplying a fuel to each cylinder of the internal combustion engine based on the detection results obtained by the sensors 1 for detecting the operating states of the internal combustion engine. The means 2 output, to a controller 4 for the cylinder injection type injectors, control signals C1 to Cn for driving the cylinder injection type injectors respectively corresponding to the cylinders of the internal combustion engine. A battery 3 serving as the power source for a vehicle supplies a battery voltage VB.

A high voltage generation means 5 for generating high voltage VH based on the voltage value VB of the battery 3 is provided within the controller 4 for the cylinder injection type injectors. The means 5 generates a high voltage VH by boosting the voltage value VB supplied by the battery 3.

Injector coils 6-1 to 6-n correspond to drive circuits 7-1 to 7-n, respectively. The injector coils 6-1 to 6-n constitute first to nth cylinder injection type injectors. The injectors, respectively arranged for the cylinders of the internal combustion engine, directly inject the fuel into the corresponding cylinders. The drive circuits 7-1 to 7-n supply currents J1 to Jn to the injector coils 6-1 to 6-n as fuel injection signals.

The injector coil drive circuits 7-1 to 7-n arranged so as to correspond to the injector coils 6-1 to 6-n supply the currents J1 to Jn, which are the fuel injection signals, to the injector coils 6-1 to 6-n, respectively, based on control signals C1 to Cn outputted from the control parameter calculation means 2.

Over-excitation signal generation means 8-1 to 8-n synchronize with the ON timings of the control signals C1 to Cn outputted from the control parameter calculation means 2, and define predetermined time intervals during which over-excitation currents necessary for initially opening the valves of the nozzles of the cylinder injection type injectors rapidly are outputted to the injector coils 6-1 to 6-n from the high voltage generation means 5 through first switching means 9-1 to 9-n, respectively. The means 8-1 to 8-n output the defined time intervals as over-excitation signals E1 to En.

The first switching means 9-1 to 9-n remain turned on while the over-excitation signals E1 to En outputted from the over-excitation signal generation means 8-1 to 8-n are held at the ON state, so that the means 9-1 to 9-n allow the over-excitation currents to be supplied to the injector coils 6-1 to 6-n from the high voltage generation means 5.

Chopping type holding current generation means 10-1 to 10-n supply, to the injector coils 6-1 to 6-n, holding currents necessary for the injectors to hold the valves of their nozzles open operation while the control signals C1 to Cn outputted from the control parameter calculation means 2 are held at the ON state (after the over-excitation time has elapsed). That is, the chopping type holding current generation means 10-1 to 10-n compare voltage values VS1 to VSn, which are the detection results obtained by current detection means 13-1 to 13-n, withholding current reference voltage values set by themselves, and intermittently supply the battery voltage VB to the injector coils 6-1 to 6-n by controlling the ON/OFF switching operations of second switching means 11-1 to 11-n so that the holding currents are always constant.

The second switching means 11-1 to 11-n start and stop the supply of the voltage value VB from the battery 3 in accordance with the outputs of the chopping type holding current generation means 10-1 to 10-n.

Third switching means 12-1 to 12-n incorporate high-speed current breaking function for rapidly turning off the currents when breaking the currents flowing through the injector coils 6-1 to 6-n. The means 12-1 to 12-n are normally turned on, and get turned off upon removal of the control signals C1 to Cn. The means 12-1 to 12-n also have the function of rapidly breaking the currents generated by induced counter-electromotive forces at the injector coils 6-1 to 6-n.

The current detection means 13-1 to 13-n detect the currents flowing through the injector coils 6-1 to 6-n. Each current detection means includes, e.g., a current-to-voltage conversion shunt resistor and a differential amplifier connected across both ends of the shunt resistor. The means 13-1 to 13-n are arranged at paths not admitting the flow of the over-excitation currents supplied from the high voltage generation means 5 to the injector coils 6-1 to 6-n through the first switching means 9-1 to 9-n, and at paths admitting the flow of all the following currents: the holding currents supplied from the battery 3 to the injector coils 6-1 to 6-n through the second switching means 11-1 to 11-n and reverse current blocking diodes D1 to Dn; commutating currents flowing when the second switching means 11-1 to 11-n are turned off; and high-speed commutating currents flowing when the third switching means 12-1 to 12-n are turned off. Thus, the current detection means 13-1 to 13-n can detect all the currents other than the over-excitation currents. Their detection results, which are the voltage values VS1 to VSn, are inputted to the chopping type holding current generation means 10-1 to 10-n and over-current detection means 14-1 to 14-n.

That is, in this embodiment, the current detection means 13-1 to 13-n are not arranged at the paths that admit the flow of the over-excitation currents supplied from the high voltage generation means 5 to the injector coils 6-1 to 6-n through the first switching means 9-1 to 9-n based on the signals from the over-excitation signal generation means 8-1 to 8-n. Instead the means 13-1 to 13-n are arranged at the paths that admit the flow of all the following currents that are to be rapidly broken by the third switching means: the holding currents supplied from the battery 3 to the injector coils 6-1 to 6-n through the second switching means 11-1 to 11-n based on the outputs of the holding current generation means 10-1 to 10-n which are required for the injectors to hold the valves of their nozzles open after the valves have been initially opened; the commutating currents of the injector coils 6-1 to 6-n flowing when the second switching means 11-1 to 11-n are turned off; and the currents flowing through the injector coils 6-1 to 6-n for closing the valves of the injector nozzles.

The over-current detection means 14-1 to 14-n detect excessively large currents flowing through the injector coils 6-1 to 6-n based on the voltage values VS1 to VSn corresponding to the currents detected by the current detection means 13-1 to 13-n, i.e., the means 14-1 to 14-n detect the fact that the values VS1 to VSn have grown larger than the reference values within the normal control range. The means 14-1 to 14-n then output voltages F1 to Fn. The values VS1 to VSn, which are the detection results obtained by the current detection means 13-1 to 13-n, do not contain over-excitation current values. Therefore, no circuits for temporarily interrupting the over-current detection during the over-excitation period are needed.

When the over-current detection means 14-1 to 14-n detect the excessively large currents flowing through the injector coils 6-1 to 6-n, failure determination holding means 15-1 to 15-n determine that the injectors for the cylinders have failed, and change the third switching means 12-1 to 12-n from the ON state to the OFF state, thereby rapidly breaking the currents flowing through the injector coils 6-1 to 6-n, and at the same time, output signals H1 to Hn for controlling the third switching means 12-1 to 12-n in order to continuously hold the third switching means 12-1 to 12-n at the OFF states during the operation period.

The diodes D1 to Dn are inserted between the second switching means 11-1 to 11-n and the current detection means 13-1 to 13-n, and are reverse current blocking diodes for blocking the flow of the over-excitation currents supplied from the high voltage generation means 5 via the first switching means 9-1 to 9-n into the second switching means 11-1 to 11-n.

Current commutation diodes D11 to Dnn constitute commutating current paths for allowing the currents flowing through the injector coils 6-1 to 6-n to continuously flow while the second switching means 11-1 to 11-n are turned off. In this case, the currents commutate through the following paths: from the injector coils 6-1 to 6-n, to the third switching means 12-1 to 12-n, then to the current commutation diodes D11 to Dnn, then to the current detection means 13-1 to 13-n, and back to the injector coils 6-1 to 6-n.

Next, the operation of the controller for the cylinder injection type injectors shown in FIG. 1 will be described with reference to the timing charts of FIGS. 2 and 3.

Figure 2:
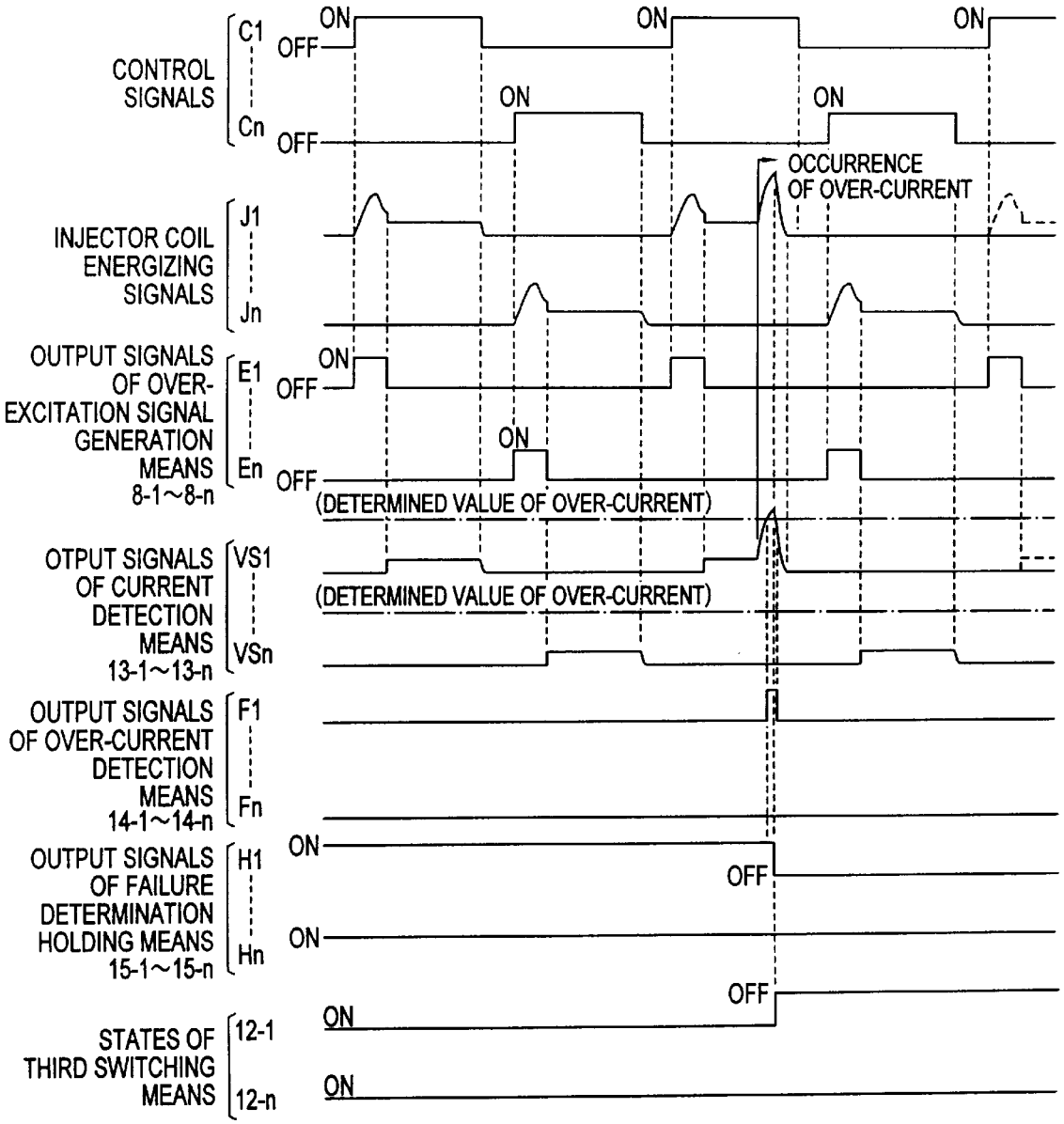
FIG. 2 is a timing chart for illustrating the operation of the controller shown in FIG. 1.

FIG. 2 shows the states of the parts of the controller in the case where an over-current has occurred at the first cylinder as a failure while the holding currents are being supplied. FIG. 3 shows the states of the parts of the controller in the case where an over-current has occurred at the first cylinder as a failure while the over-excitation currents are being supplied.

The battery 3 supplies the battery voltage VB to the high voltage generation means 5, and in response thereto, the means 5 generates the high voltage VH that is higher than the battery voltage VB.

Further, the control parameter calculation means 2 calculates various control parameters for the internal combustion engine, e.g., fuel injection amount and fuel injection period for each cylinder of the internal combustion engine based on the information about the operation of the internal combustion engine detected by the sensors 1. Then, the control parameter calculation means 2 supplies to the drive circuit 7-1 to 7-n the control signals C1 to Cn that serve to open the valves of the nozzles of the injectors respectively provided for the cylinders.

The over-excitation signals E1 to En outputted from the over-excitation signal generation means 8-1 to 8-n of the drive circuits 7-1 to 7-n become at high level H in response to the initial turning on of the control signals C1 to Cn, respectively. As the over-excitation signals E1 to En has gone high, the first switching means 9-1 to 9-n turn on, thereby causing the high voltage generation means 5 to supply large over-excitation currents to the injector coils 6-1 to 6-n through the first switching means 9-1 to 9-n. As a result, the valves of the injector nozzles are initially opened.

When the high level H of the over-excitation signals E1 to En go low, the first switching means 9-1 to 9-n turn off. During the remaining period in which the control signals C1 to Cn are still turned on, the holding current generation means 10-1 to 10-n supply the predetermined currents J1 to Jn to the injector coils 6-1 to 6-n from the battery 3 through the second switching means 11-1 to 11-n, the reverse current blocking diodes D1 to Dn and the current detection means 13-1 to 13-n, thereby holding the valves of the injector nozzles open. In this case, voltages corresponding to the currents detected by the current detection means 13-1 to 13-n are supplied to the holding current generation means 10-1 to 10-n, thereby effecting a feedback control so that the currents J1 to Jn flowing through the injector coils 6-1 to 6-n are held constant.

When the control signals C1 to Cn turn off, the supply of the currents to the injector coils 6-1 to 6-n from the battery 3 is stopped, thereby causing the high-speed current breaking means incorporated in the third switching means 12-1 to 12-n to rapidly break the currents J1 to Jn flowing through the injector coils 6-1 to 6-n.

Further, when the over-current detection means 14-1 to 14-n have detected, as their output signals F1 to Fn, the currents J1 to Jn flowing through the injector coils 6-1 to 6-n as being excessive based on the voltages detected by the current detection means 13-1 to 13-n, the control signals H1 to Hn outputted from the failure determination holding means 15-1 to 15-n become at low level L to turn off the third switching means 12-1 to 12-n. As a result, the excessive currents flowing through the injector coils are broken.

Further, in the case where an over-current has occurred at the first cylinder as a failure while the holding currents are being supplied as shown in FIG. 2, the control signal H1 changes from high level H to low level L. At the same time, the corresponding third switching means 12-1 turns off, and only the current J1 flowing through the injector coil 6-1 corresponding to the first cylinder is broken.

Figure 4:
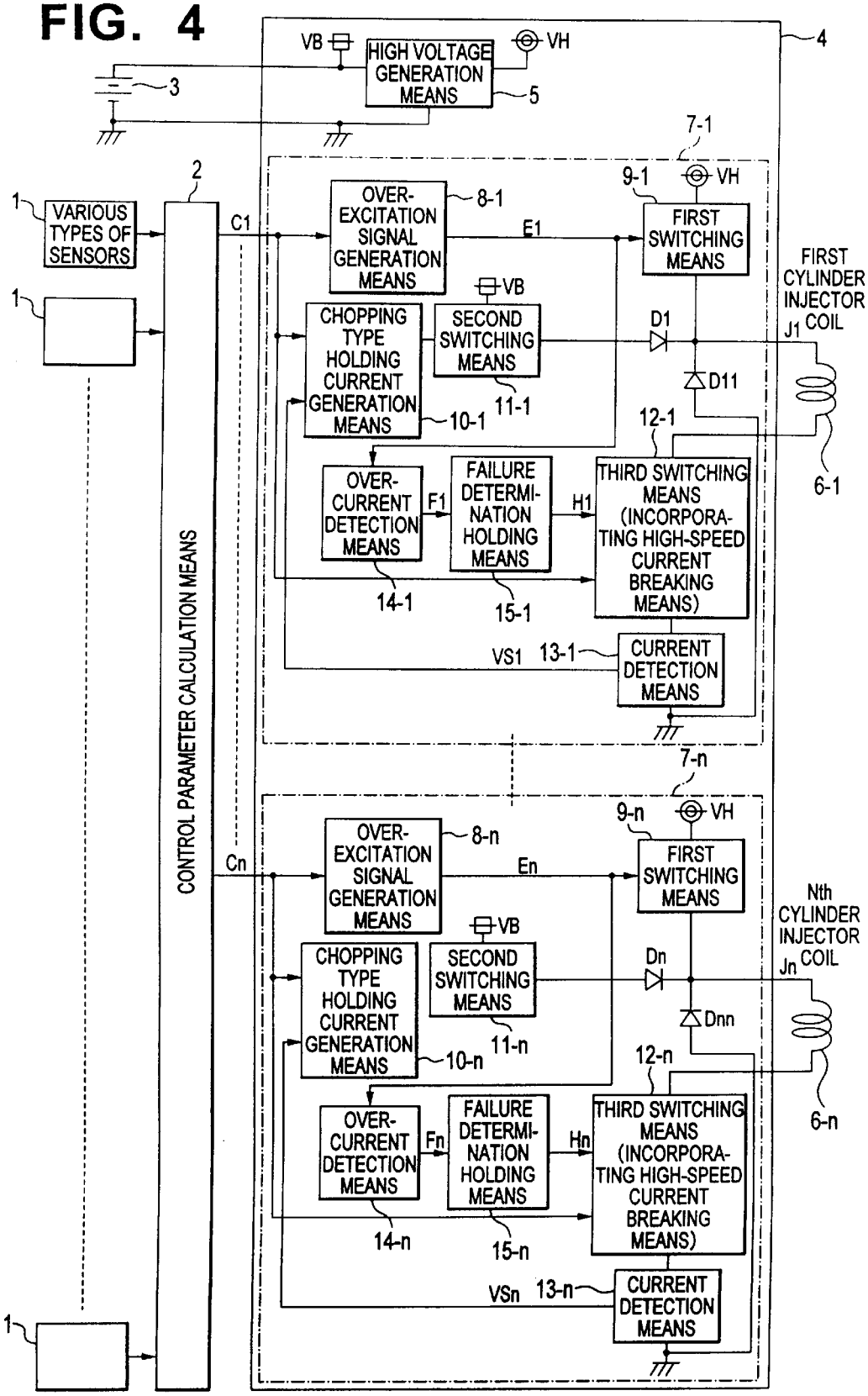
PRIOR ART FIG. 4
FIG. 4 is a diagram showing the construction of a conventional controller for cylinder injection type injectors.

Note that the injector coils 6-1 to 6-n allow large currents to flow therethrough at the initial period of their over-excitation, and that these large currents should not be mistaken for over-currents that are failures. In order to prevent these large currents from being detected as failures, the over-current detection means 14-1 to 14-n of FIG. 4 are designed to abstain themselves from detecting over-currents during the initial period of over-exciting the injector coils in which the over-excitation signals E1 to En outputted from the over-excitation signal generation means 8-1 to 8-n remain at high level H. However, in this embodiment, the over-current detection means 14-1 to 14-n detect excessively large currents flowing through the injector coils 6-1 to 6-n based on the voltage values VS1 to VSn corresponding to the currents detected by the current detection means 13-1 to 13-n, i.e., the means 14-1 to 14-n detect the fact that the values VS1 to VSn have grown larger than the reference values within the normal control range, and output the voltage values F1 to Fn. Therefore, the values VS1 to VSn, which are the detection results obtained by the current detection means 13-1 to 13-n, do not contain over-excitation current values, and hence no circuits for temporarily interrupting the over-current detection during the over-excitation period are needed.

Figure 3:
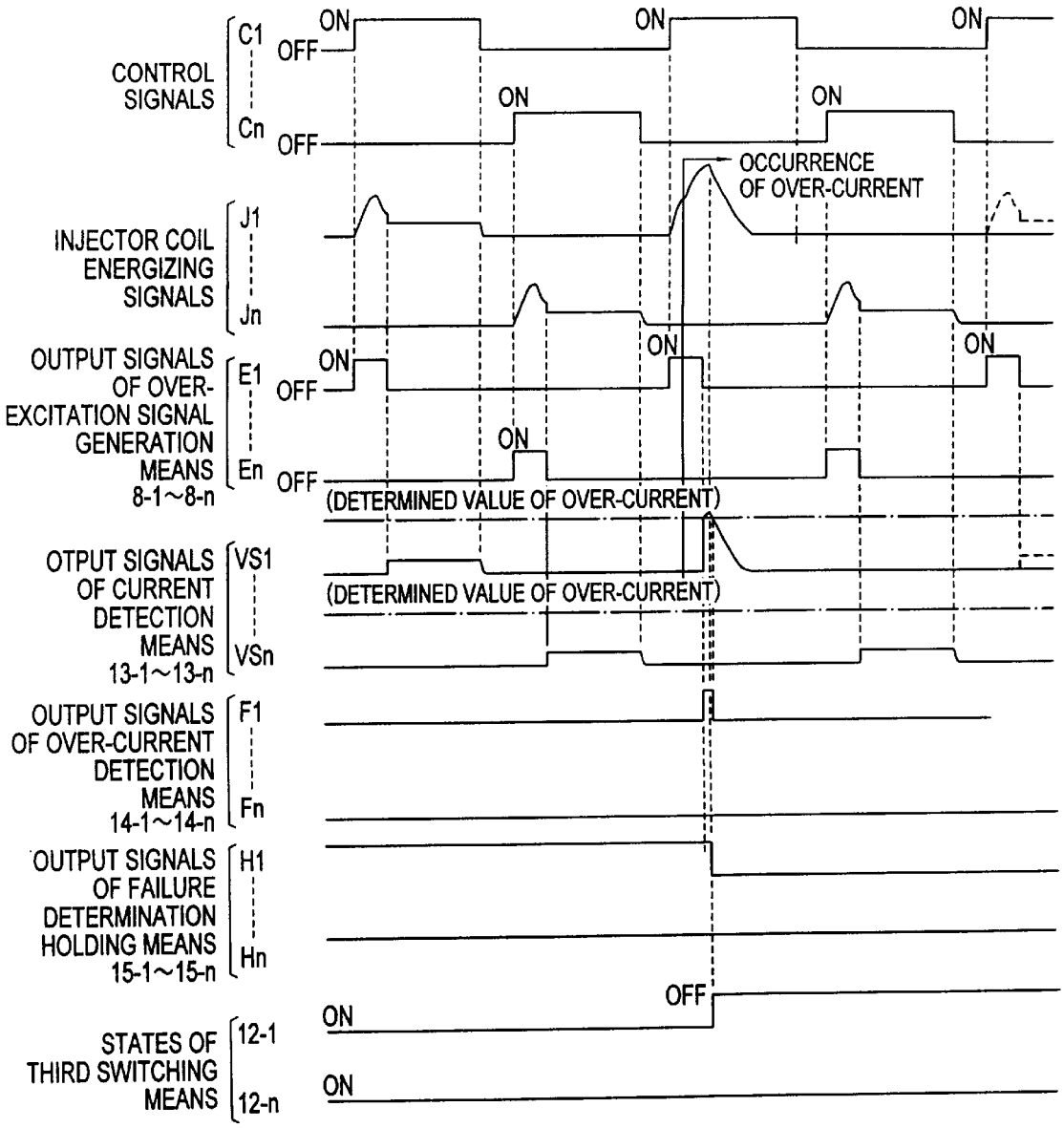
FIG. 3 is a timing chart for illustrating the operation of the controller shown in FIG. 1.

Further, as shown in FIG. 3, in the case where an over-current has occurred at the first cylinder as a failure during the initial period of over-excitation, such an over-current is detected by the corresponding current detection means 13-1, and the control signal F1 that is an output signal of the over-current detection means 14-1 causes the output signal H1 of the failure determination holding means 15-1 to change from high level H to low level L. At the same time, the corresponding third switching means 12-1 turns off, and only the current J1 flowing through the injector coil 6-1 corresponding to the first cylinder is broken.

As described above, this embodiment allows the current detection means to be constructed with small-power parts by arranging the current detection means on the paths through which no over-excitation currents flow. In addition, this embodiment provides a small-sized, light-weight and inexpensive controller for cylinder injection type injectors which contributes to reducing heat, reducing the circuit scale and downsizing the controller by eliminating circuits for temporarily interrupting the function of the over-current detection means only during the period in which over-excitation currents are being supplied.

What is claimed is:

1. A controller for cylinder injection type injectors comprising:

various types of sensors for detecting operating states of an internal combustion engine;

control parameter calculation means for calculating control parameters, which are a fuel injection amount and a fuel injection period for supplying a fuel to each cylinder of the internal combustion engine, based on the detection results obtained by said various types of sensors;

high voltage generation means for generating a high voltage power supply for supplying over-excitation currents necessary for initially opening valves of injector nozzles to injector coils based on the result of a calculation made by said control parameter calculation means;

over-excitation signal generation means for defining predetermined time intervals for supplying the over-excitation currents to the injector coils;

first switching means for supplying the over-excitation currents to the injector coils from said high voltage generation means based on the outputs of said over-excitation signal generation means;

holding current generation means for generating holding currents which are necessary to hold the valves of the injector nozzles open and which are supplied to the injector coils after the over-excitation currents have been supplied;

second switching means for supplying the holding currents to the injector coils from a battery based on the outputs of said holding current generation means;

third switching means for breaking currents flowing through the injector coils in order to close the valves of the injector nozzles;

current detection means, arranged at paths not admitting the flow of the over-excitation currents supplied from said high voltage generation means through said first switching means, for detecting currents flowing through the injector coils;

over-current detection means for detecting excessively large currents flowing through the injector coils based on the detection results obtained by said current detection means; and failure determination holding means for holding said third switching means at the disenergized states based on the detection results obtained by said over-current detection means.

2. A controller for cylinder injection type injectors according to claim 1, wherein said over-current detection means can detect all over-currents derived from failures during an energized period based on the detection results obtained by said current detection means.

3. A controller for cylinder injection type injectors according to claim 1, wherein said current detection means are arranged at paths admitting all of holding currents supplied to the injector coils through said second switching means, commutating currents flowing while said second switching means are turned off, and high-speed commutating currents flowing while the third switching means are turned off, and can detect all currents other than the over-excitation currents.

* * * * *